US008072130B2

(12) United States Patent
Wang et al.

(10) Patent No.: US 8,072,130 B2
(45) Date of Patent: Dec. 6, 2011

(54) LED LAMP

(75) Inventors: Zhong-Qing Wang, Shenzhen (CN); Xiu-Yi Zhang, Shenzhen (CN); Chin-Chung Chen, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/770,757

(22) Filed: Apr. 30, 2010

(65) Prior Publication Data

US 2011/0148271 A1 Jun. 23, 2011

(30) Foreign Application Priority Data

Dec. 22, 2009 (CN) ..... 2009 1 0312021

(51) Int. Cl.
*H01J 61/52* (2006.01)
*F21V 29/00* (2006.01)

(52) U.S. Cl. ..... 313/318.01; 313/318.12; 313/512; 313/46; 362/264; 362/294; 362/373

(58) Field of Classification Search ..... None
See application file for complete search history.

(56) References Cited

U.S. PATENT DOCUMENTS

2010/0301747 A1* 12/2010 Huang et al. ..... 315/35
2011/0133652 A1* 6/2011 Chen ..... 315/112

* cited by examiner

*Primary Examiner* — Ashok Patel
(74) *Attorney, Agent, or Firm* — Altis Law Group, Inc.

(57) ABSTRACT

An LED lamp includes a connecting member and an LED module. The connecting member is adapted for electrically connecting with a power source. The LED module is clasped by and electrically connects to the connecting member.

18 Claims, 5 Drawing Sheets

LED LAMP

BACKGROUND

1. Technical Field

The present disclosure relates to LED (light emitting diode) lamps, and more particularly to an LED lamp having a low energy consumption.

2. Description of Related Art

The conventional light sources, such as fluorescent lamp, halogen lamp and incandescent lamp need large power consumption. It is environmentally unfriendly and energy consumptive.

It is thus desirable to provide an LED lamp which can overcome the described limitations.

DETAILED DESCRIPTION

Figure 1:
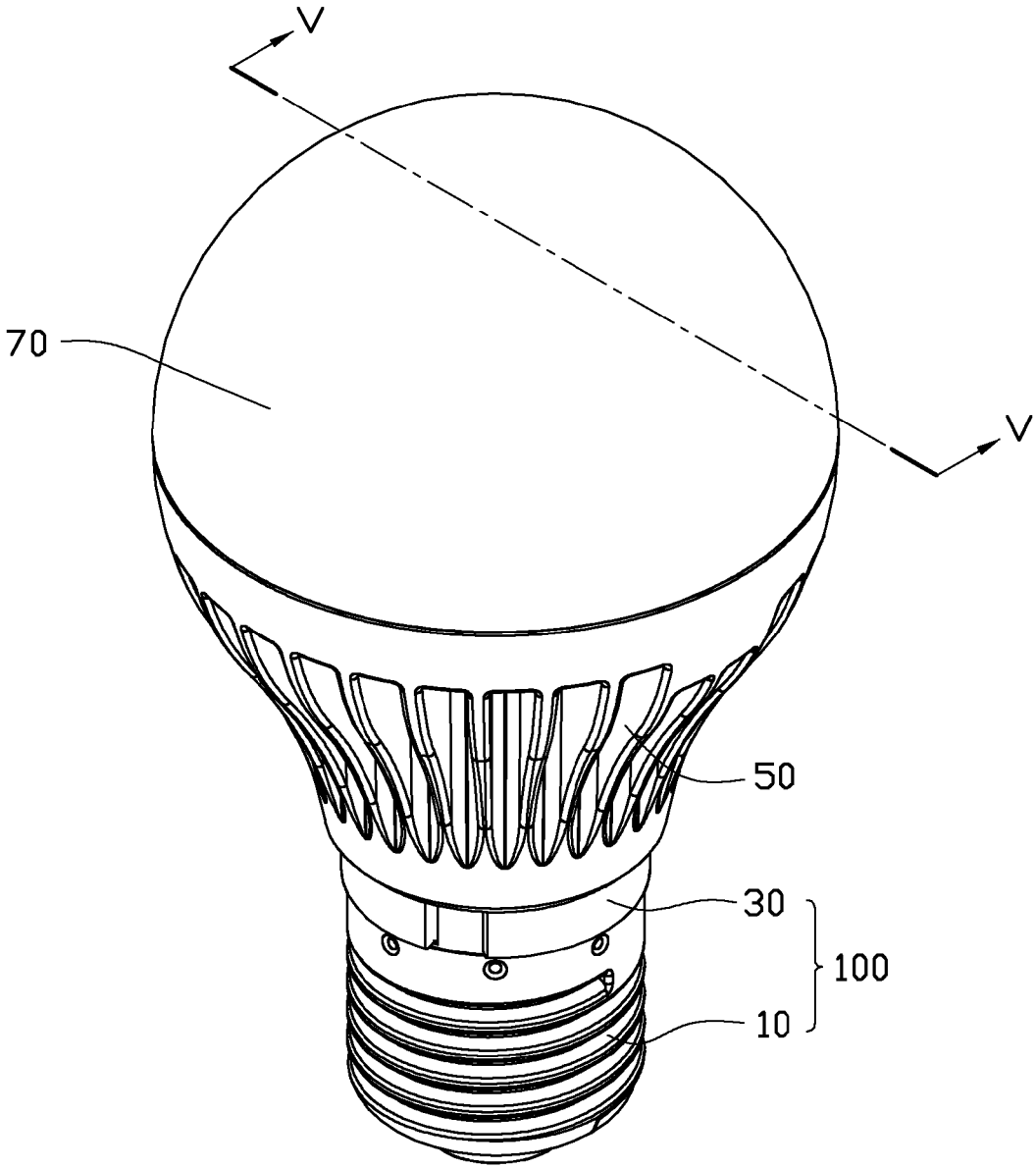
FIG. 1 is an assembled view of an LED lamp according to an embodiment of the present disclosure.
Figure 2:
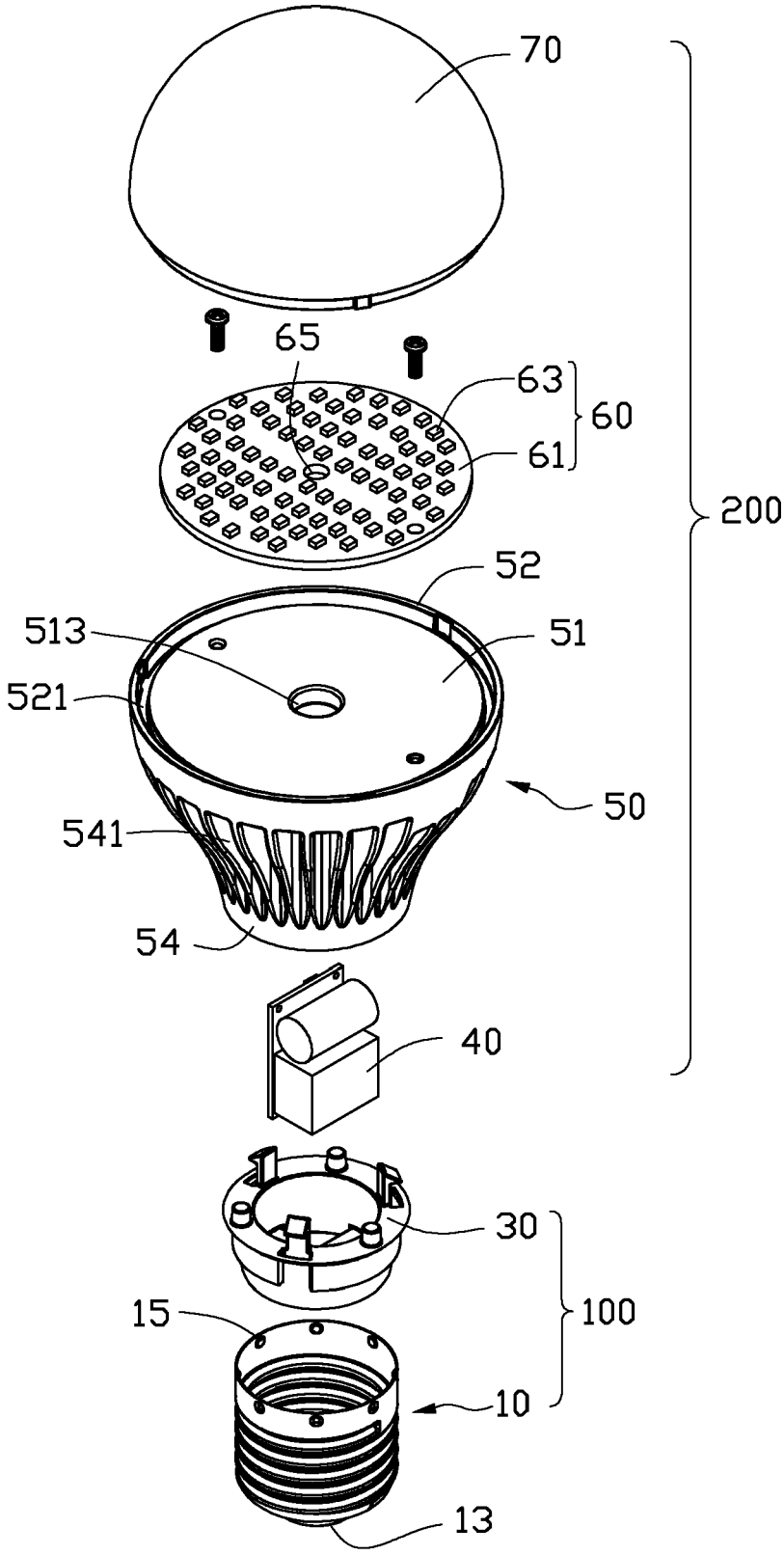
FIG. 2 is an exploded view of the LED lamp of FIG. 1.
Figure 3:
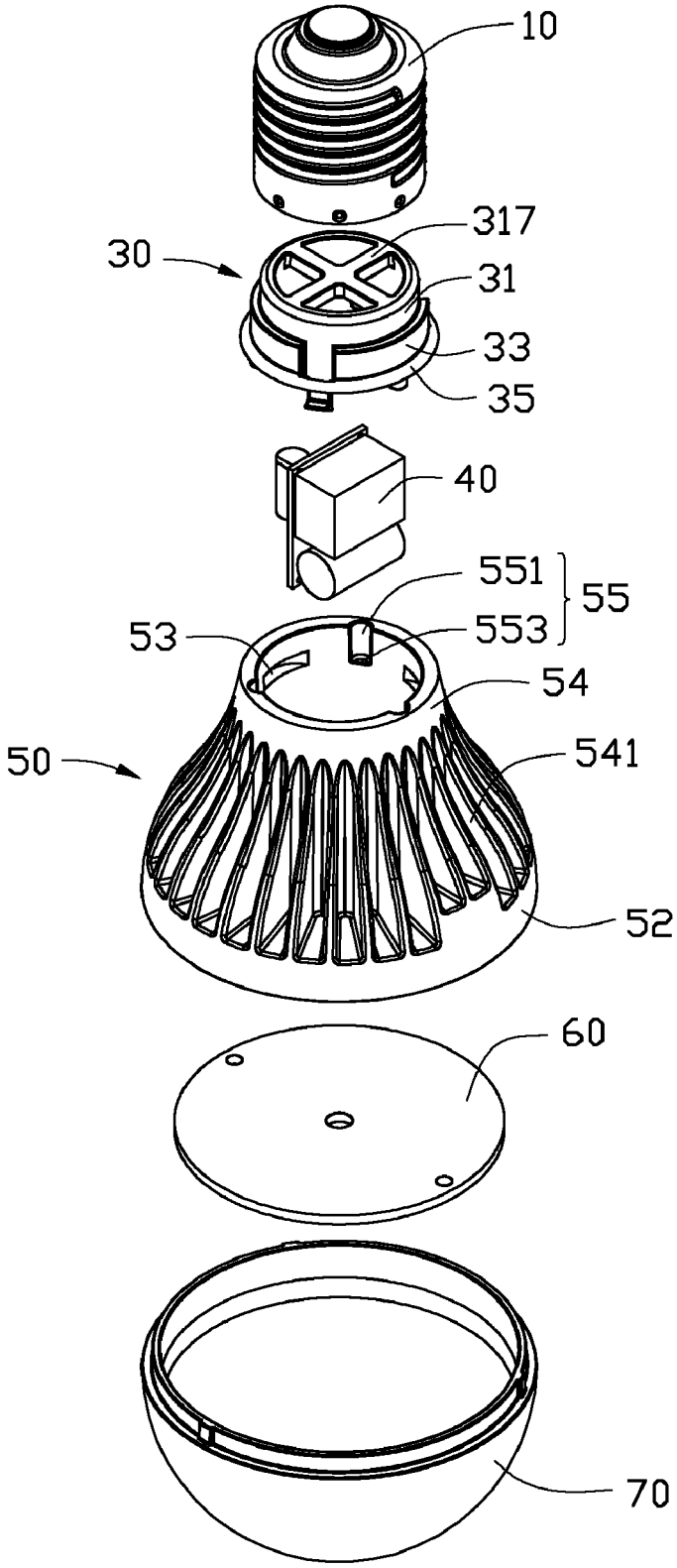
FIG. 3 is an inverted view of FIG. 2.

Referring to FIGS. 1-3, an LED lamp according to an embodiment includes a connecting member 100 for electrically connecting a power source (not shown) and an LED module 200 engaging with the connecting member 100. The connecting member 100 includes a connector 30 and a holder 10 engaging with a bottom end of the connector 30. The holder 10 is configured for screwing to a socket (not shown) to electrically connect the power source. The LED module 200 includes a supporting member 50 engaging with a top end of the connector 30, an LED unit 60 received in the supporting member 50, and an envelope 70 mounted on the supporting member 50 and covering the LED unit 60.

The holder 10 is a hollow tube with the bottom end thereof being closed. A metallic patch 13 is formed on an outside of the bottom end of the holder 10. The metallic patch 13 functions as a positive electrode, and a threaded periphery (not labeled) of the holder 10 functions as a negative electrode to electrically connect the power source to drive the LED unit 60 to lighten. The holder 10 is a standard element, so the LED lamp can be directly connect to a standard socket matching with the standard holder 10 to electrically connect with the power source. Thus, the LED lamp of the present disclosure can replace the traditional incandescent bulb and compact fluorescent bulb. A plurality of protruded points 15 are formed on an inner surface of the top end of the holder 10. The protruded points 15 are evenly arranged along a circumferential direction of the holder 10.

Figure 5:
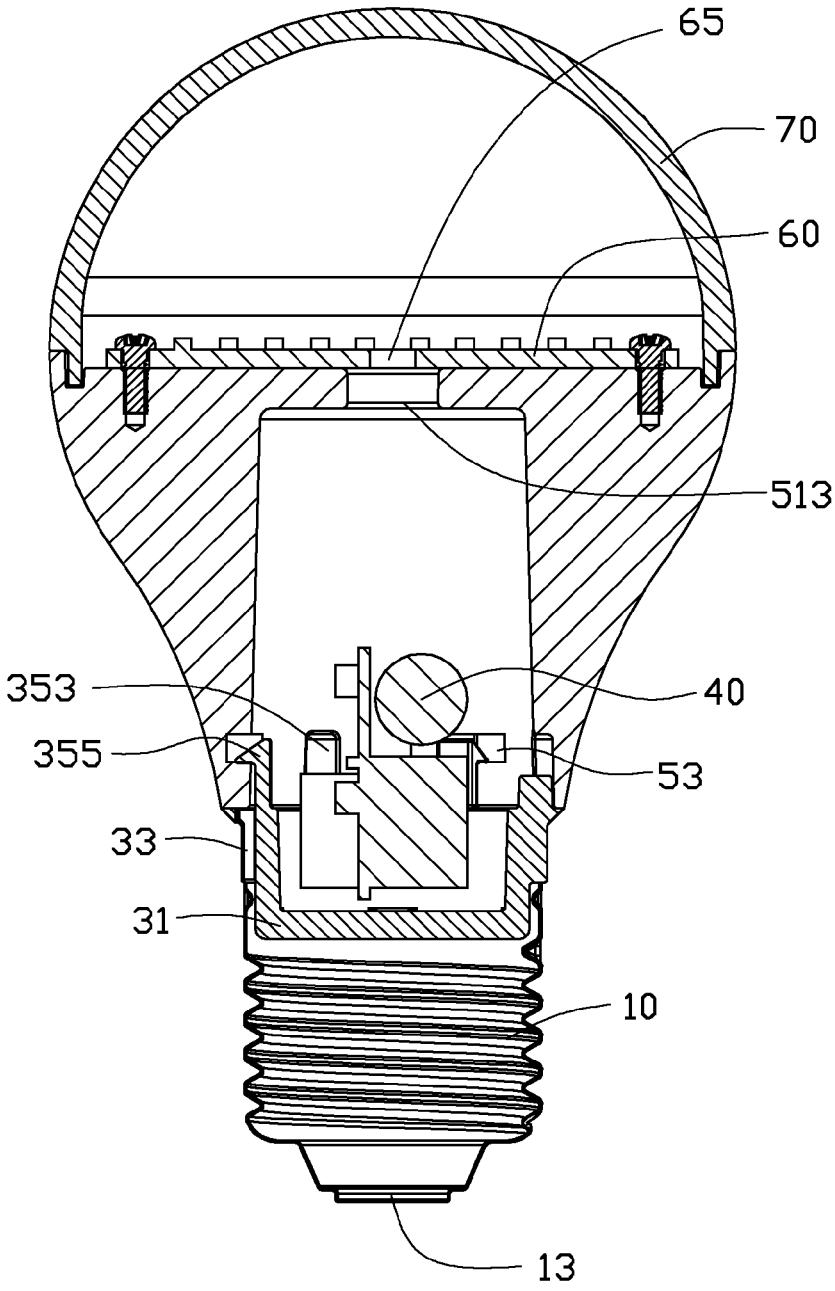
FIG. 5 is a cross-sectional view of the LED lamp of FIG. 1, taken along line V-V thereof.

Referring also to FIGS. 2-3 and FIG. 5, the supporting member 50 is made of aluminum, copper or alloy thereof. The supporting member 50 includes a circular supporting plate 51, an annular baffling plate 52 extending upwardly from an outer periphery of a top side of the supporting plate 51, and a hollow, cone-shaped heat dissipating portion 54 extending downwardly from an outer periphery of a bottom side of the supporting plate 51. The baffling plate 52 is an annular plate. A groove 521 is defined between the supporting plate 51 and the baffling plate 52 to receive the envelope 70. An outer diameter of the heat dissipating portion 54 axially decreases from a top end to a bottom end of the heat dissipating portion 54, while an inner diameter of the heat dissipating portion 54 is constant. The supporting plate 51 and the baffling plate 52 cooperatively form a receiving chamber (not labeled) to receive the LED unit 60 therein. The groove 521 surrounds the receiving chamber and communicates with the receiving chamber. A central portion of the supporting plate 51 defines a through hole 513 therein to allow wires (not shown) extending therethrough to electrically connect the holder 10 and the LED unit 60. A plurality of fins 541 radially extend from an outer circumferential surface of the heat dissipating portion 54 to dissipate heat of the heat dissipating portion 54. Three engaging portions 53 are evenly defined in a bottom end of the heat dissipation portion 54. Three receiving portions 55 are evenly formed on an inner surface of the heat dissipation portion 54. The receiving portions 55 and engaging portions 53 are arranged in alternate fashion along a circumferential direction of the supporting member 50. In this embodiment, the engaging portions 53 are slots and extend along the circumferential direction of the inner surface of the heat dissipation portion 54. Each of the receiving portions 55 includes a groove 551 and a blind hole 553. The groove 551 communicates with the blind hole 553. The groove 551 is located at a bottom portion of the heat dissipation portion 54 and the blind hole 553 is located above the groove 551.

Figure 4:
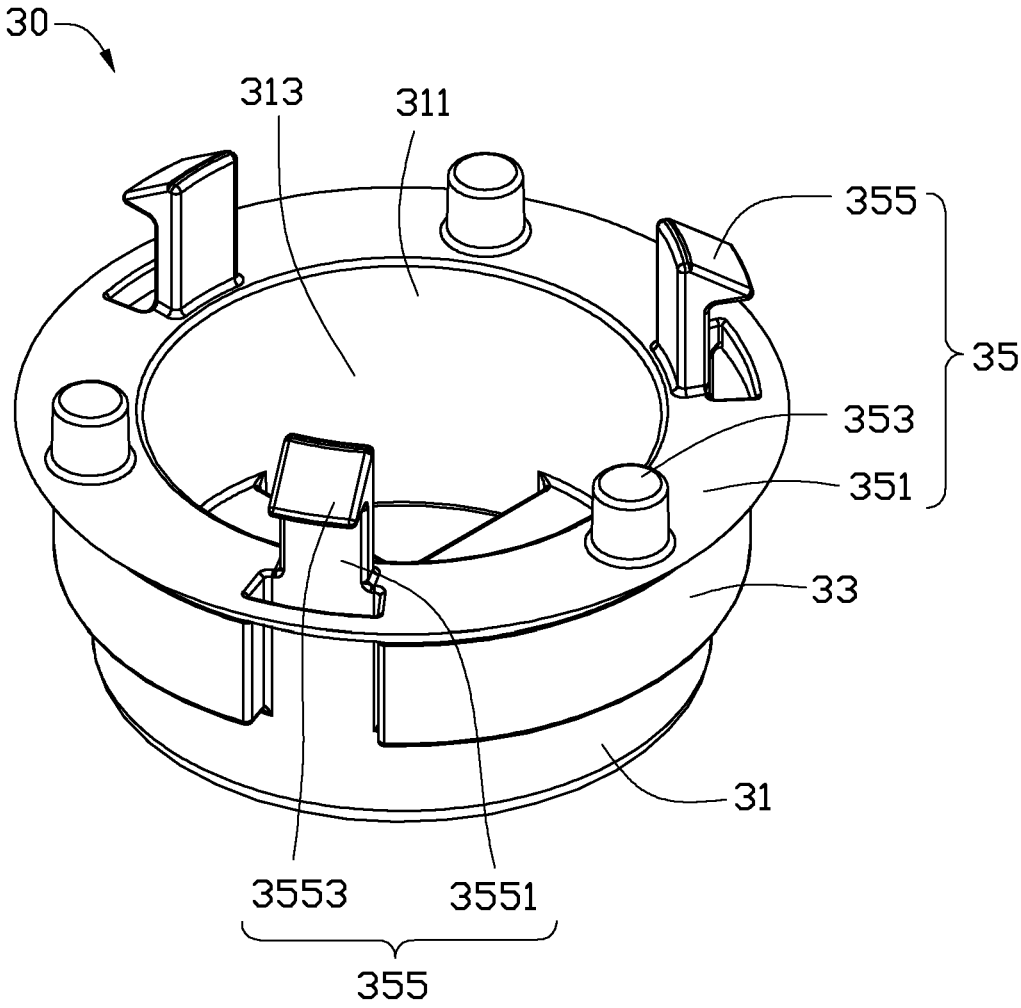
FIG. 4 is an enlarged view of a connector of the LED lamp shown in FIG. 2.

Referring to FIG. 4 again, the connector 30 includes a joining member 31, a baffling member 33 and a linking member 35. The joining member 31 has a hollow, cylinder-shaped configuration, and has an opening 311 and a cross-shaped bottom plate 317. A driving circuit module 40 is received in the joining member 31 and electrically connects the LED unit 60. The baffling member 33 is annular, and protrudes outwards from a top of an outer circumferential surface of the joining member 31. That is, the outer diameter of the baffling member 33 is larger than that of the joining member 31. A bottom end of the joining member 31 is received in the top end of the holder 10 and interferes with the protruded points 15, thereby fixedly connecting the connector 30 and the holder 10 together.

The linking member 35 includes three hooks 355, three posts 533 and a shoring plate 531. The hooks 355 extend upwardly form the top end of the joining member 31. The three hooks 355 are evenly arranged on the top end of the joining member 31 along a circumference direction of the joining member 31. The hook 355 includes an elongated engaging plate 3551 connecting the joining member 31 and a ridge-shaped pressing portion 3553 extending downwardly and slantwise from a top end of the engaging plate 3551. The hooks 355 are received in the heat dissipation portion 54, and the pressing portions 3553 clasp the engaging portions 53 of the heat dissipation portion 54 of the supporting member 50. Thus, the connecting member 100 and the LED module 200 are assembled together.

The three posts 353 are evenly arranged on the top end of the joining member 31 along the circumference direction of the joining member 31. The hooks 355 and the posts 353 are arranged in alternate fashion. The posts 353 are received in the grooves 551 and engaged in the blind holes 553 of the receiving portions 55 of the heat dissipation portion 54 of the supporting member 50, respectively. The post 353 prevents the supporting member 50 from turning relative to the connector 30. The shoring plate 351 extends outwardly from the top end of the joining member 31. The shoring plate 351 abuts against the bottom end of the heat dissipation portion 54. Preferably, the outer diameter of the joining member 31 is slightly larger than an inner diameter of the holder 10, while the outer diameter of the baffling member 33 is quite larger than the inner diameter of the holder 10 and the outer diameter of the shoring plate 351 is quite larger than the inner diameter of the bottom end of the heat dissipation portion 54.

The LED unit 60 includes a disc-shaped printed circuit board 61 and a plurality of LEDs 63 mounted on a top surface of the printed circuit board 61. The printed circuit board 61 is secured on the supporting plate 51 and thermally contacts with the supporting plate 51 of the supporting member 50. A through hole 65 is defined in a central portion of the printed circuit board 61 for extension of the wires therethrough to allow the driving circuit module 40 to electrically connect with the LED unit 60.

The envelope 70 is made of a light permeable material and has a hollow, hemispherical-shape. A bottom edge of the envelope 70 is received in the groove 521 of the supporting member 50.

When the LEDs 63 operate to give off light, heat is accordingly produced. The heat generated by the LEDs 63 is transferred to the supporting plate 51 and then to the heat dissipating portion 54 and the fins 541 to dissipate into surrounding air. Thus the heat of the LEDs 63 can be quickly removed, thereby significantly improving lifespan of the LEDs 63. Further, since the LEDs 63 are a highly efficient light source with a high brightness, a long lifespan, and a wide color range, the LED lamp with the LEDs 63 functioning as a light source is energy-saving and environment-friendly.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED lamp comprising:

a connecting member adapted for electrically connecting with a power source; and an LED module clasped by and electrically connected to the connecting member;

wherein the connecting member comprises a connector and a holder, the connector includes a joining member, one end of the joining member is received in the holder and another end of the joining member forms a plurality of hooks, the LED module forms a plurality of engaging portions, and the hooks clasp the engaging portions.

2. The LED lamp of claim 1, wherein the one end of the joining member is securely received in the holder.

3. The LED lamp of claim 1, wherein each hook comprises an engaging plate connecting the joining member and a pressing portion clasping a corresponding engaging portion of the LED module.

4. The LED lamp of claim 1, wherein each of the engaging portions of the LED module is a slot.

5. The LED lamp of claim 1, wherein the connector comprises a baffling member formed on a top of an outer surface of the joining member and abutting against the holder.

6. The LED lamp of claim 1, wherein the connector comprises a plurality of posts extending from another end of the joining member, the LED module defines a plurality of holes, and the posts are respectively received in the holes of the LED module.

7. The LED lamp of claim 1, wherein the connector further comprises a shoring plate extending outwardly from the joining member and abutting against the LED module.

8. The LED lamp of claim 1, wherein the LED module comprises a supporting member and an LED unit received in the supporting member, the LED unit electrically connecting with the holder.

9. The LED lamp of claim 8, wherein the supporting member comprises a supporting plate on which the LED unit is arranged and a hollow heat dissipating portion extending downwardly from the supporting plate, and the engaging portions are formed on the heat dissipation portion.

10. The LED lamp of claim 9, wherein each of the engaging portions is a slot and each of the hooks is a clasp.

11. The LED lamp of claim 9, wherein the LED module comprises a baffling plate extending upwardly from the supporting plate and surrounding the LED unit.

12. The LED lamp of claim 11, wherein a groove is defined between the baffling plate and the supporting plate, the LED module further comprises an envelope, and a bottom end of the envelope is received in the groove.

13. The LED lamp of claim 9, wherein a plurality of fins extend outwardly from the heat dissipating portion for increasing a heat exchanging area of the heat dissipating portion.

14. An LED lamp comprising:

a connecting member adapted for electrically connecting with a power source, the connecting member comprising a connector and a holder, and a plurality of hooks formed on the connector; and an LED module, the LED module comprising a supporting member and an LED unit, the supporting member comprising a supporting plate and a hollow heat dissipating portion extending downwardly from the supporting plate, the LED unit received in the heat dissipating portion, and a plurality of engaging portions formed on the heat dissipation portion;

wherein one end of the connector is received in the holder and the hooks located at another end of the connector clasp the engaging portions of the heat dissipating portion, the LED unit is arranged on the supporting plate and electrically connects with the holder.

15. The LED lamp of claim 14, wherein each of the engaging portions is a slot and each of the hooks is a clasp.

16. The LED lamp of claim 14, wherein the LED module comprises a baffling plate extending upwardly from the supporting plate and surrounding the LED unit.

17. The LED lamp of claim 16, wherein a groove is defined between the baffling plate and the supporting plate, the LED module further comprises an envelope, and a bottom end of the envelope is received in the groove.

18. The LED lamp of claim 14, wherein a plurality of fins extend outwardly from the heat dissipating portion for increasing a heat exchanging area of the heat dissipating portion.

* * * * *